US008635794B1

(12) United States Patent
Thigpen et al.

(10) Patent No.: US 8,635,794 B1
(45) Date of Patent: Jan. 28, 2014

(54) MODULAR INFLATABLE SCENE

(76) Inventors: Jerry W. Thigpen, Bonita Springs, FL (US); Renee M. Thigpen, Bonita Springs, FL (US)

( * ) Notice: Subject to any disclaimer, the term of this patent is extended or adjusted under 35 U.S.C. 154(b) by 33 days.

(21) Appl. No.: 13/413,016

(22) Filed: Mar. 6, 2012

(51) Int. Cl.
*A63H 3/06* (2006.01)

(52) U.S. Cl.
USPC ..... 40/610; 40/539; 446/220

(58) Field of Classification Search
USPC ..... 40/610; 446/220, 223, 225–227; 472/134
See application file for complete search history.

(56) References Cited

U.S. PATENT DOCUMENTS

| | | | | |
|---|---|---|---|---|
| D123,192 | S | 10/1940 | Schafhausen | |
| 2,731,768 | A * | 1/1956 | Harrowe | 446/226 |
| 3,190,657 | A * | 6/1965 | Johnson | 473/196 |
| 5,335,436 | A | 8/1994 | Gurr | |
| 5,402,591 | A * | 4/1995 | Lee | 40/610 |
| 5,662,509 | A * | 9/1997 | Lieberman | 446/220 |
| 5,745,941 | A * | 5/1998 | Miller, Sr. | 5/710 |
| 5,797,208 | A * | 8/1998 | Lessa | 43/2 |
| D435,229 | S | 12/2000 | Fairman | |
| 6,186,857 | B1 | 2/2001 | Gazit et al. | |
| 6,634,133 | B1 * | 10/2003 | Levandowski | 43/3 |
| 6,644,843 | B2 | 11/2003 | Chin-Cheng | |
| 6,786,793 | B1 | 9/2004 | Wang | |
| D500,701 | S | 1/2005 | Shaw, Jr. | |
| 7,356,951 | B2 * | 4/2008 | Spielberger et al. | 40/412 |
| 2002/0094746 | A1 | 7/2002 | Harlev | |
| 2002/0111109 | A1 * | 8/2002 | Kwan | 446/220 |

* cited by examiner

*Primary Examiner* — Casandra Davis
(74) *Attorney, Agent, or Firm* — Montgomery Patent & Design; Robert C. Montgomery

(57) ABSTRACT

An inflatable display having figurines that are selectively attached to a display base using a pneumatic coupling comprised of an inflating coupling having an annular groove that mates with an inflating port having a ring seal. The base and individual figurines are made of a breathable yet inflatable fabric material. Openings through the base allow air pressure supplied by an electric blower to inflate the figurines via the pneumatic couplings. The display is kept in place by a series of guy ropes and stakes placed around the perimeter of the base and some figurines can include an interior light.

18 Claims, 7 Drawing Sheets

MODULAR INFLATABLE SCENE

RELATED APPLICATIONS

There are currently no applications with the present application.

FIELD OF THE INVENTION

The presently disclosed subject matter relates to inflatable displays. More specifically, it relates to inflatable displays having figurines that are selectively attached to a base by an air connection comprised of an inflating coupling with an annular groove and an inflating port having a ring seal. Openings in the base allow the figurines to be inflated by an air blower.

BACKGROUND OF THE INVENTION

In the last couple of decades inflatable figurines have become very popular. Such figurines are used to sell automobiles, as holiday backgrounds, and to depict cultural and religious scenes. Inflatable figurines are useful because they are easily set up and taken down, are relatively low cost, are available in a wide variety of figures, and are easily moved.

Typical prior art inflatable figurines are similar to balloons. They are blown up, sealed against air leaks, and put in place. While such inflatable figurines are useful they have certain disadvantageous. They are typically relatively simple items, the will slowly leak, temperature changes will cause different internal air pressures which will tend to deflate or overinflate them, and environmental factors such as wind and rain will disturb them.

One (1) approach to avoiding the foregoing issues is to use a continuously inflated figurine. In such figurines an air blower continuously or at least repetitiously pressurizes the figurine. Another approach to the foregoing problems is to either protect the figurine by keeping it indoors or to provide a shield against raid and wind. Yet another approach to the foregoing issues is to "tie down" the figurine.

The success of inflatable figurines has created its own problem. Users have demanded larger, more intricate figurines and scenes that feature multiple figurines. Instead of a simple figurine multiple figurines having intricate designs and layouts are demanded. Fulfilling that demand was initially relatively easy: simply fabricate a single figurine having multiple individual elements and more intricate designs. That however created a demand that was far more difficult to address: customizable inflatable scenes.

Consider a Nativity scene. It has such religious and cultural significance that individual users often want to configure their Nativity scene to meet their own religious, cultural, family, and social configurations which may have deep seated significance. For example, some individuals or families will want to start the Christmas season with a Nativity scene having just a stable, then over time adding different animals and people until Christmas morning when the infant Jesus is displayed in a manger. Later, wise-men might be added to the Nativity scene along with different gifts and activities, such as a drummer boy playing.

Another problem with customizable inflatable scenes is space limitations, ground limitations, light limitations and other limitations that impact on inflatable scenes.

Prior art inflatable and configurable scenes have not fulfilled user demands. They tend to leak too much, are too difficult to set up, are rather unwieldy in configurability, have limited size, are too costly, or other problems may exist.

Therefore, a technique of creating highly configurable inflatable scenes at low cost would be useful. Even more useful would be a technique of creating highly configurable inflatable scenes that are not only low cost and highly configurable, but also able to be used outdoors or in varying environmental conditions. Preferably such highly configurable inflatable scenes would be easy to set up, to take down, and to move.

SUMMARY OF THE INVENTION

The principles of the present invention provide a technique for creating highly configurable inflatable scenes at low cost. Those principles enable scenes that are not only highly configurable but can be used outdoors or in varying environmental conditions, are easy to set up, to take down, to configure, and to move.

The principles of the present invention provide for an inflatable scene having a base that is comprised of a breathable and inflatable fabric material. The base includes at least one (preferably many) inflating port having a semi-rigid seal ring located around an opening through the base. An inflatable scene may further include a figurine that is also comprised of a breathable and inflatable fabric material. The figurine could have a coupling that is comprised of a hollow cylindrical conduit with an annular groove that is dimensioned to mate with the seal ring. An air blower pressurizes the base and the figurine. The figurine is attached to the base by the coupling and by the inflating port.

In some versions the seal ring is permanently attached to the base. A tethered plug have an annular groove that mates to the seal ring to prevent air from coming out of the opening can be attached to the base. In most applications there will be multiple inflating ports arranged along the base. A flexible hose can be used to connect the base to the air blower. Usually, the air blower will be AC-powered. A ring anchor on the base can be used to attach the inflatable scene to the ground. The figurine can include an internal lamp assembly, which may be battery-powered and selectively applied by a switch.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
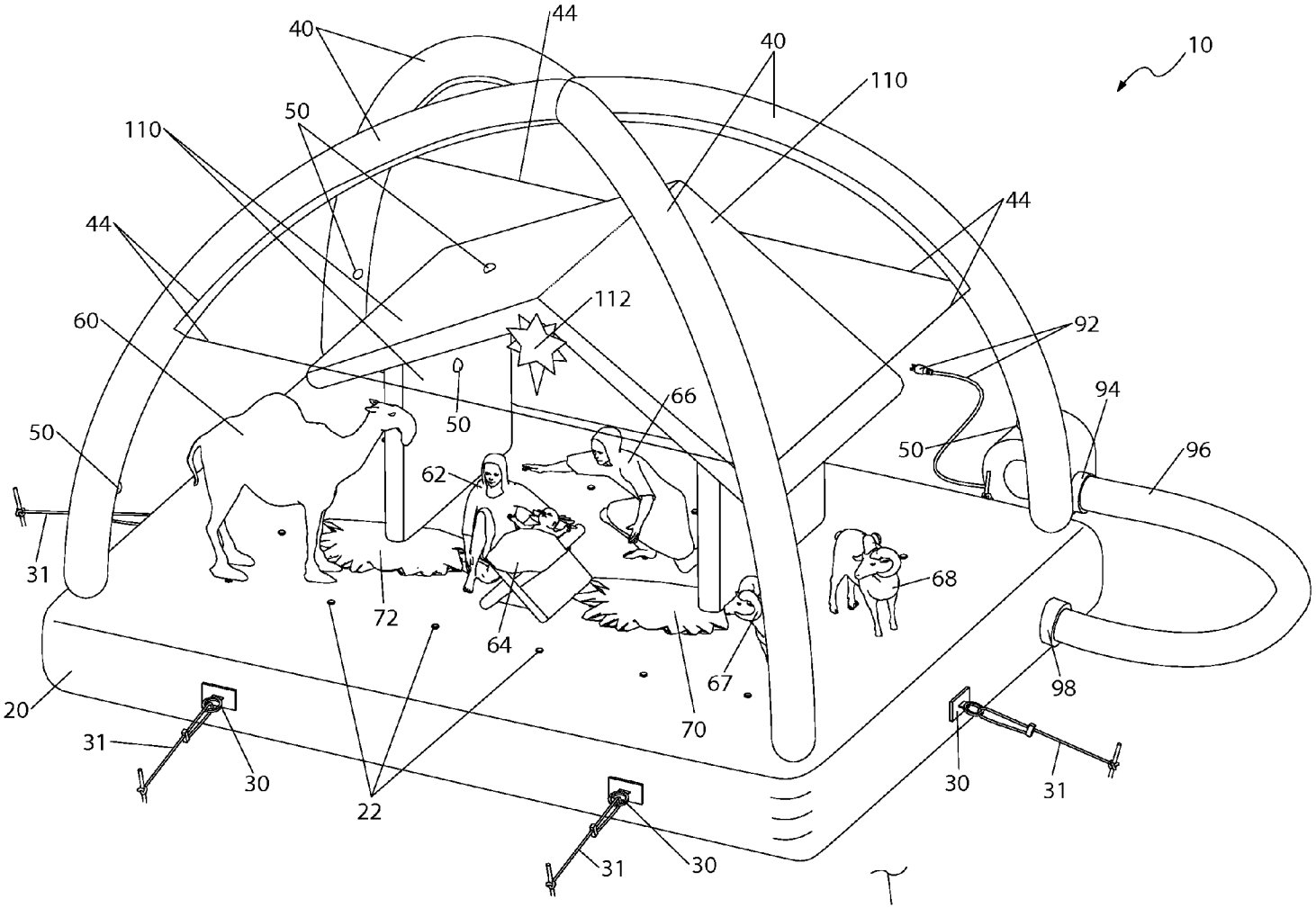
FIG. 1 is a perspective view of an inflatable Nativity scene 10 according to a preferred embodiment of the present invention.

10 Nativity scene
20 base
22 inflating port
30 ring anchor
31 guy-rope assembly
40 super structure
44 canopy section
50 lamp assembly
51 lamp
52 lamp holder
53 lamp socket
54 bayonet mount
55 adhesive attachment
56 battery
57 power switch
60 first figurine
62 second figurine
64 third figurine
66 fourth figurine
67 fifth figurine
68 sixth figurine
70 seventh figurine
72 eighth figurine
77 lamp aperture
78 inflating coupling
80 annular groove
82 ring seal
84 opening
86 plug
90 blower
92 power cord
94 first connection
96 air hose
98 second connection
110 stable figurine
112 star figurine
115 ground surface

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention provide for highly configurable inflatable scenes, such at a Nativity scene 10 illustrated in FIGS. 1-7. While the principles of the present invention are applicable to may different inflatable scenes, the specifically described Nativity scene 10 is very useful for showing and describing those principles.

Figure 2:
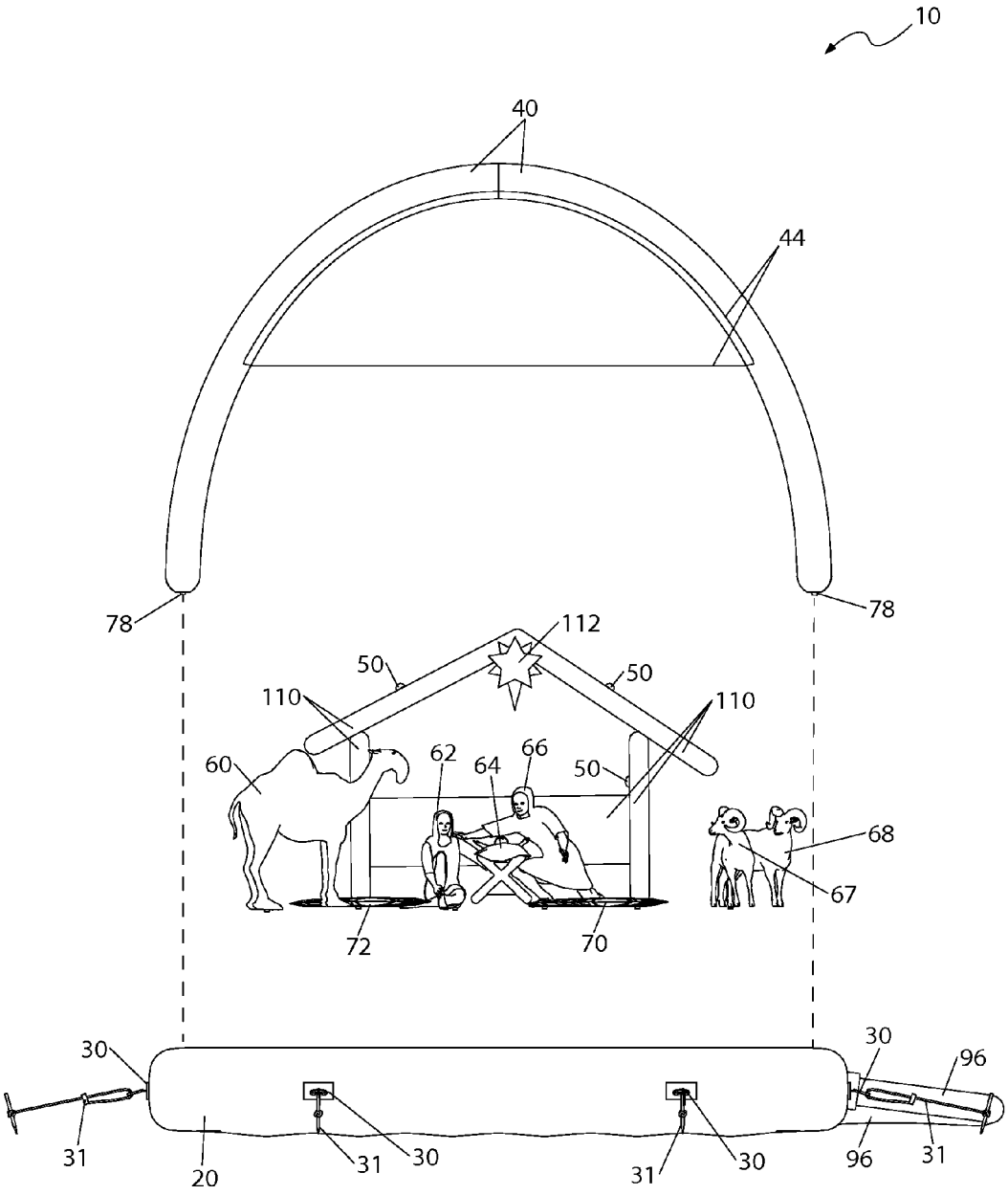
FIG. 2 is an exploded view of the inflatable Nativity scene 10 depicted in FIG. 1.
Figure 3:
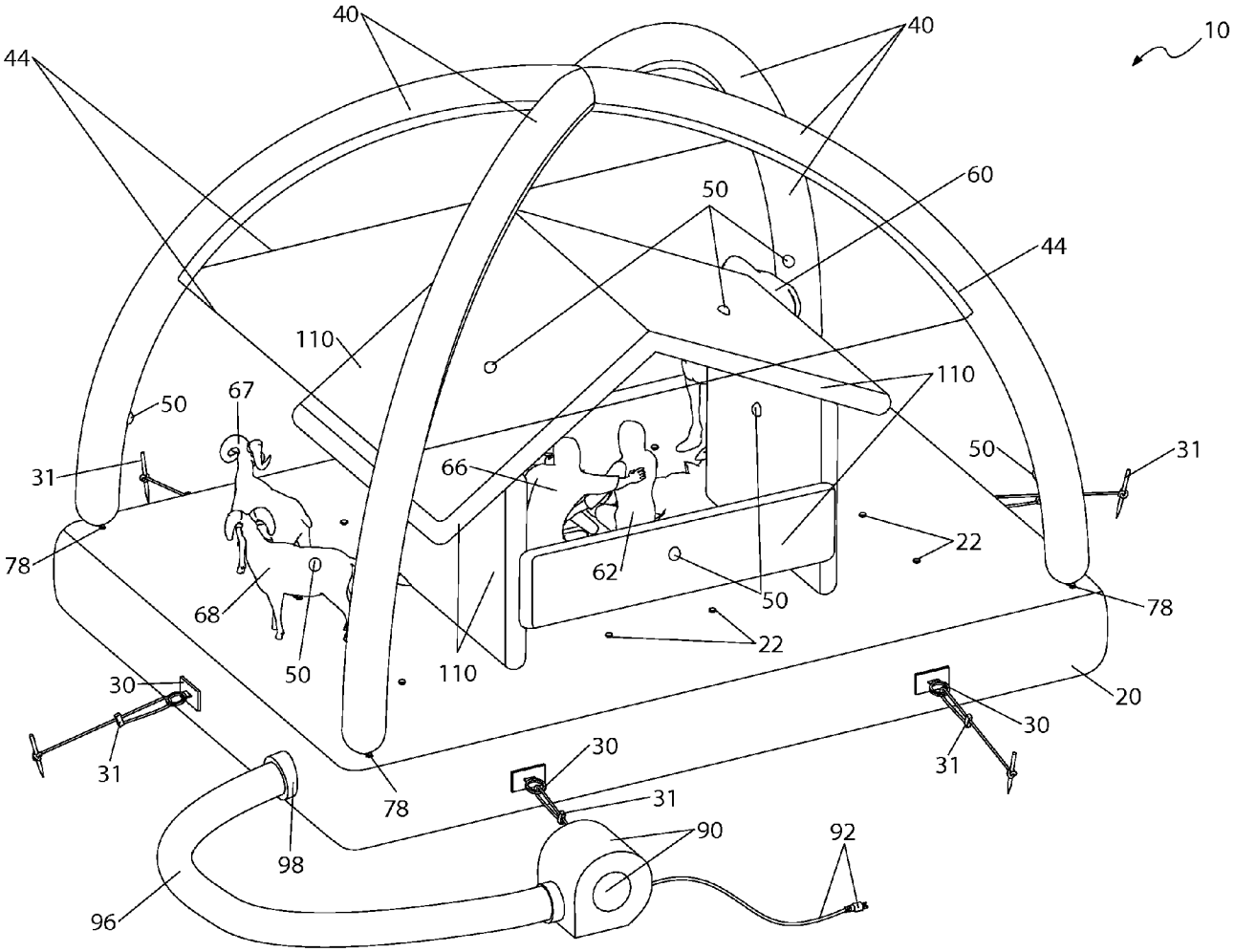
FIG. 3 is a rear perspective view of the inflatable Nativity scene 10 depicted in FIGS. 1 and 2.

Referring now mostly to FIGS. 1-3, the inflatable Nativity scene 10 is an air pressure powered decorative assembly having an over-arching super-structure 40 figurine and a plurality of other figurines. Those figurines include (not all figurines are shown in each of the FIGS. 1-3) a first figurine 60, illustrated as a camel, a second figurine 62, illustrated as Mary, a third figurine 64, illustrated as an infant Jesus, a fourth figurine 66 illustrated as Joseph, a fifth figurine 67 illustrated as a sheep, a sixth figurine 68 illustrated as another sheep, a seventh figurine 70 illustrated as bedding, an eighth figurine 72 illustrated as more bedding material, and a stable figurine 110. The stable figurine 110 is envisioned as being a shelter having walls and a peak roof. The stable figurine 110 further includes an integral star figurine 112 along it top forward area. It is envisioned that the figurines 40, 60, 62, 64, 66, 67, 68, 70, 72, 110, and other figurines as desired, may be introduced in various forms, in lesser or greater number, and at different times by using the air couplings that are subsequently described. The various figurines can be air coupled to each other or to a base 20.

Still referring to FIGS. 1-3, the Nativity scene 10 is made from a breathable yet inflatable fabric material. That is, the fabric material allows pressurized air to pass through rather slowly and such that a continuously operating air blower 90 can keep the entire Nativity scene 10 inflated. Various artificial fibers when given certain weaves, such as overlapped nylon or polyester thread weaves are particularly suitable fabric materials. The blower 90 provides a flow of pressurized air into the base 20 via a length of flexible hose 96. The flexible hose 96 has a first connection 94 at the blower 90, see FIG. 1, and a second connection 98, at the base 20. The blower 90 is envisioned as being a high-flow, low-pressure air pump similar to commercially-available units that are commonly used to inflate mattresses and other types of pneumatic outdoor decorations. Due to the breathable nature of the fabric the blower 90 is envisioned as running at a one-hundred percent (100%) duty cycle during use. Thus suitable existing blowers or modifications to existing blowers to allow continuous operation may be required. The blower 90 is AC powered and has a power cord 92 for plugging into a 110-volt AC power outlet.

The first connection 94 of the hose 96 provides a half-turn bayonet attachment to the blower 90, thereby allowing easy disassembly and compact storage of the Nativity scene 10 when not being used. In a similar manner, the second connection 98 is an integral portion of the hose 96 and is preferably permanently connected to a short side portion of the base 20.

Figure 4:
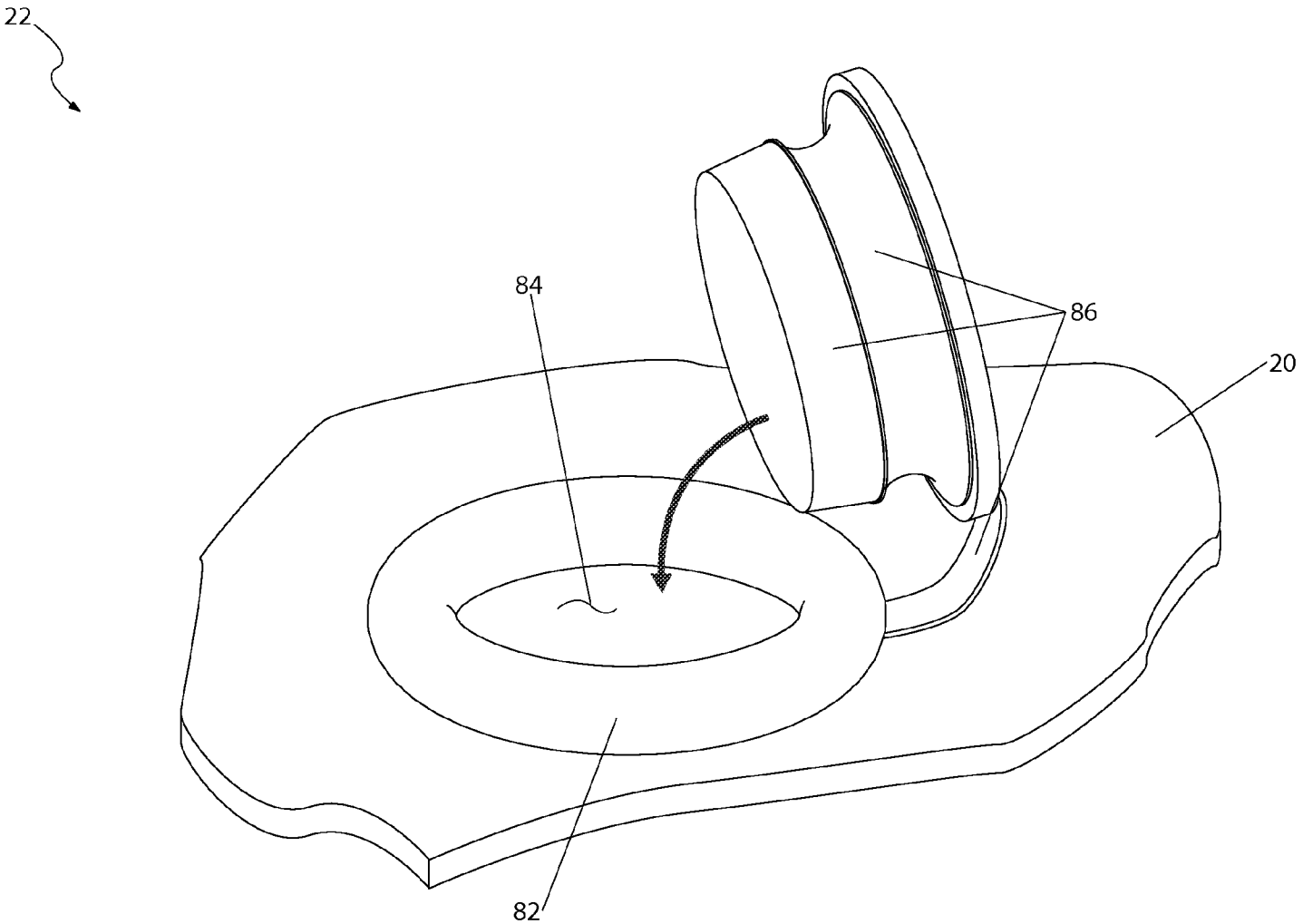
FIG. 4 is a close-up view of an inflating port portion 22 of the inflatable Nativity scene 10 according to a preferred embodiment of the present invention.

Referring now to FIGS. 1, 2, and 4, the base 20 includes a plurality of integral inflating ports 22 which enable pressurized air in the base 20 to pass into the figurines 40, 60, 62, 64, 66, 67, 68, 70, 72, 110. That is, the inflating ports 22 are configured to mate with the figurines. To that end, and to enable flexibility in configuring the Nativity scene 10, beneficially there are a rather large number of inflating ports 22 arranged along the base 20 in an equally-spaced manner and along perpendicular rows and columns, approximately one (1) foot apart.

Figure 5:
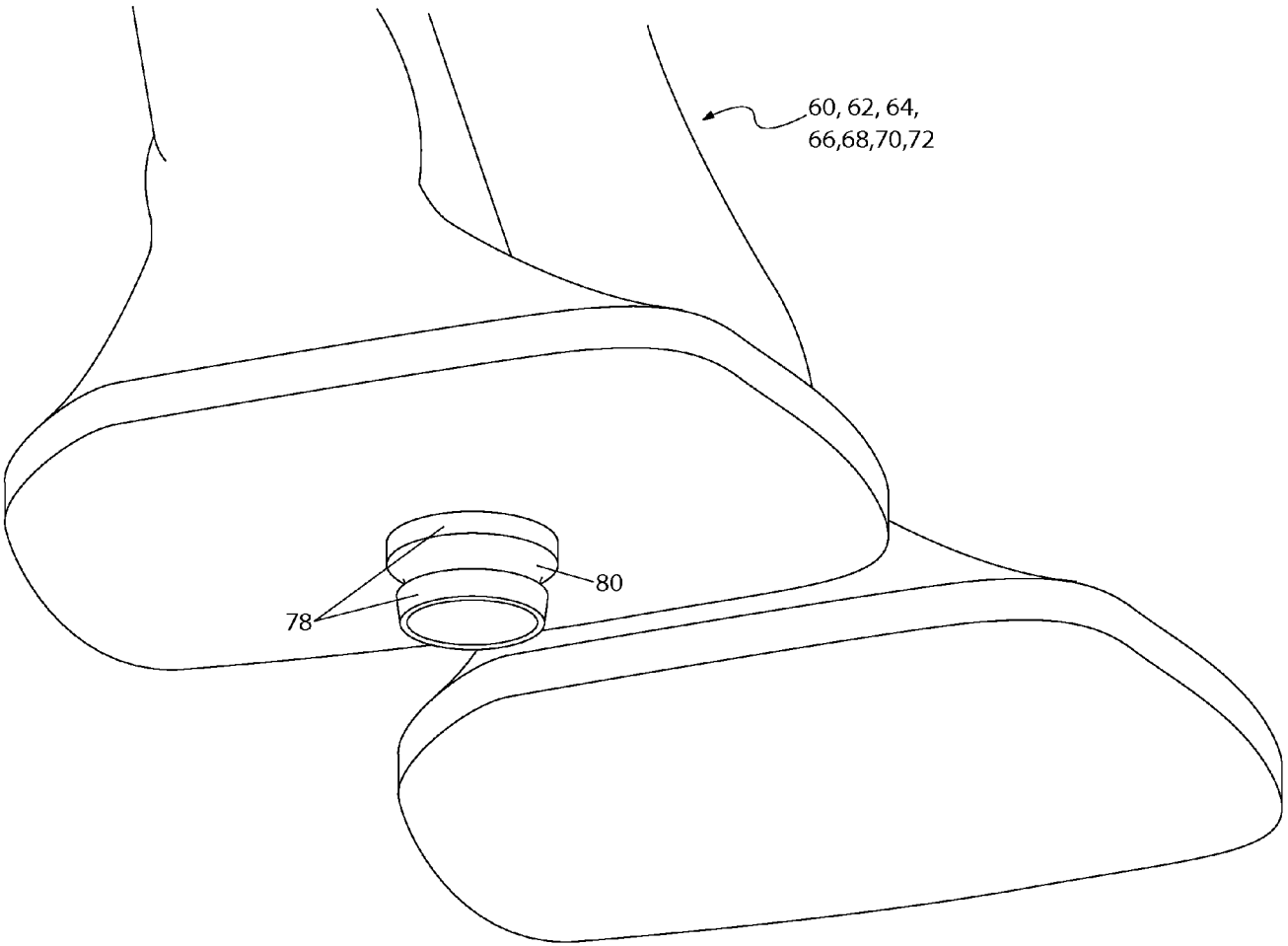
FIG. 5 is an upward-looking close-up view of an inflating coupling portion 78 of the Nativity scene 10 according to a preferred embodiment of the present invention.

Turning now to FIGS. 4 and 5, the air distribution features of the Nativity scene 10 allow the figurines 40, 60, 62, 64, 66, 67, 68, 70, 72, 110 to be added, positioned, and removed to create any number of attractive arrangements by connecting a figurine coupling portion 78 having an annular groove 80 of a figurine 40, 60, 62, 64, 66, 67, 68, 70, 72, 110 to an inflating port 22. Each inflating port 22 includes a seal ring 82 that selectively mates with either the annular groove 80 of a figurine coupling portion 78 or to an integral tethered plug 86 having a similar annular groove 80 to prevent air leakage. The selective use of inflating ports 22, figurines 40, 60, 62, 64, 66, 67, 68, 70, 72, 110, and tethered plugs 86 also allowing removal, installation, and reconfiguration of selected figurines 40, 60, 62, 64, 66, 67, 68, 70, 72, 110 and the sealing of unused inflating ports 22 to create a desired display.

Still referring to FIGS. 4 and 5, the annular grooves 80 and seal rings 82 provide both physical support for the figurines 40, 60, 62, 64, 66, 67, 68, 70, 72, 110 and reduce or eliminate air leakage at the couplings of figurines 40, 60, 62, 64, 66, 67, 68, 70, 72, 110 to the base 20. This configuration allows air pressure to be sustained in the base 20 while also allowing the figurines 40, 60, 62, 64, 66, 67, 68, 70, 72, 110 to be filled with sufficient air pressure to support them. Again, it is envisioned that the air pump 90 runs on a 100% duty cycle, thus unavoidable air leaks between the annular grooves 80 and seal rings 82 will not cause the Nativity scene 10 to collapse.

Turning back to FIGS. 1-3, the super structure 40 includes a pair of bow shaped tubular portions that arranged in a crossing pattern. The super structure 40 is attached to the base 20 via respective inflating couplings 78 that are integral to the four (4) lower ends of the super structure 40. The inflating couplings 78 are inserted and attached into the corresponding inflating ports 22 at corner areas of the base 20. The superstructure 40 further comprises four (4) canopy sections 44 which span between upper bow shaped portions of the superstructure 40 to form transparent triangularly-shaped surfaces having horizontal bottom edges that are slightly above the subjacent figurines 40, 60, 62, 64, 66, 67, 68, 70, 72, 110. The canopy sections 44 are envisioned as being made of transparent flexible extruded plastic sheet stock bonded to the super structure 40 surfaces using plastic welding, adhesives, or other strong plastic joining methods. The canopy sections 44 provide protection to the figurines 40, 60, 62, 64, 66, 67, 68, 70, 72, 110 from rain, snow, and other inclement weather conditions while maintaining clear visibility of the figurines 40, 60, 62, 64, 66, 67, 68, 70, 72, 110.

The overall size of the Nativity scene 20 is envisioned as being approximately eight (8) feet in height, eight (8) feet in width, and three (3) to four (4) feet in depth; however, it is understood that scaled-up or scaled-down versions of the Nativity scene or of other scenes (such as Thanksgiving scenes, scenes of national holidays, or many other scenes) may be introduced based upon space limitations, desired number of figurines and a user's preference without deviating from the principles of the present invention.

Returning to FIGS. 1-3, the base 20 is secured to a ground 115 (see FIG. 1) or other surface using a plurality of equally-spaced ring anchors 30 that are arranged along perimeter sides of the base 20. The ring anchors 30 comprise circular rubber or plastic protrusions having integral rectangular attachments that are permanently affixed to the base 20 using common methods such as adhesives, plastic welding, or the like. The ring anchors 30 secure the Nativity scene 10 to the ground surface 115 via guy-rope assemblies 31 comprising a length of rope, a length adjuster mechanism, and a stake.

Turning once more to FIGS. 4 and 5 each inflating port 22 has a ring seal 82 and a tethered plug 86. The seal rings 82 are beneficially comprised of plastic or rubber torus-shaped semi-rigid ring structures which are welded or adhesively bonded to a top surface of the base 20 to form a coplanar sealed connection. The ring seals 82 convey pressurized air from an opening 84 in the base 20 to the inflating coupling portions 78 of each figurine 40, 60, 62, 64, 66, 67, 68, 70, 110. It is understood that each inflatable figurine 40, 60, 62, 64, 66, 67, 68, 70, 110 comprises at least one (1) integral inflating coupling 78, thereby enabling a removable attachment to the base 20 via insertion of the respective inflating coupling 78 into the corresponding ring seal 82.

An animal figurine is illustrated as having a first foot comprising an integral air conveying and inflating coupling 78. The open internal construction of each figurine 40, 60, 62, 64, 66, 67, 68, 70, 72, 110 allows distribution of the pressurized air using a singular inflating coupling 78; however, a plurality of inflating couplings 78 may be applied to a single figurine for added stability or securing, and as such should not be interpreted as a limiting factor of the Nativity scene 10.

Each inflating coupling 78 has a hollow cylindrical conduit in fluid communication with an internal space of each figurine 40, 60, 62, 64, 66, 67, 68, 70, 72, 110. The inflating couplings 78 enables securely affixing the figurines 40, 60, 62, 64, 66, 67, 68, 70, 72, 110 to the base 20 in such a manner as to convey a flow of pressurized air from the opening 84. After attachment, the figurines 40, 60, 62, 64, 66, 67, 68, 70, 72, 110 are subsequently inflated by the supplied pressurized air. Each inflating coupling 78 and ring seal 82 is beneficially made of a semi-rigid plastic material. Each ring seal 82 has an inner diameter that is sized to provide a secure fit around a corresponding annular groove 80 of the inflating coupling 78. The snapping engagement of the inflating couplings 78 and ring seals 82 provides secure attachment of the figurines 40, 60, 62, 64, 66, 67, 68, 70, 72, 110 to the base 20 so as to withstand external forces such as wind or other environmental factors which might dislodge the figurines 40, 60, 62, 64, 66, 67, 68, 70, 72, 110. Each seal ring 82 has an integral tethered plug 86 which may be selectively utilized to prevent air leakage from any seal rings 82 not being utilized.

Figure 6:
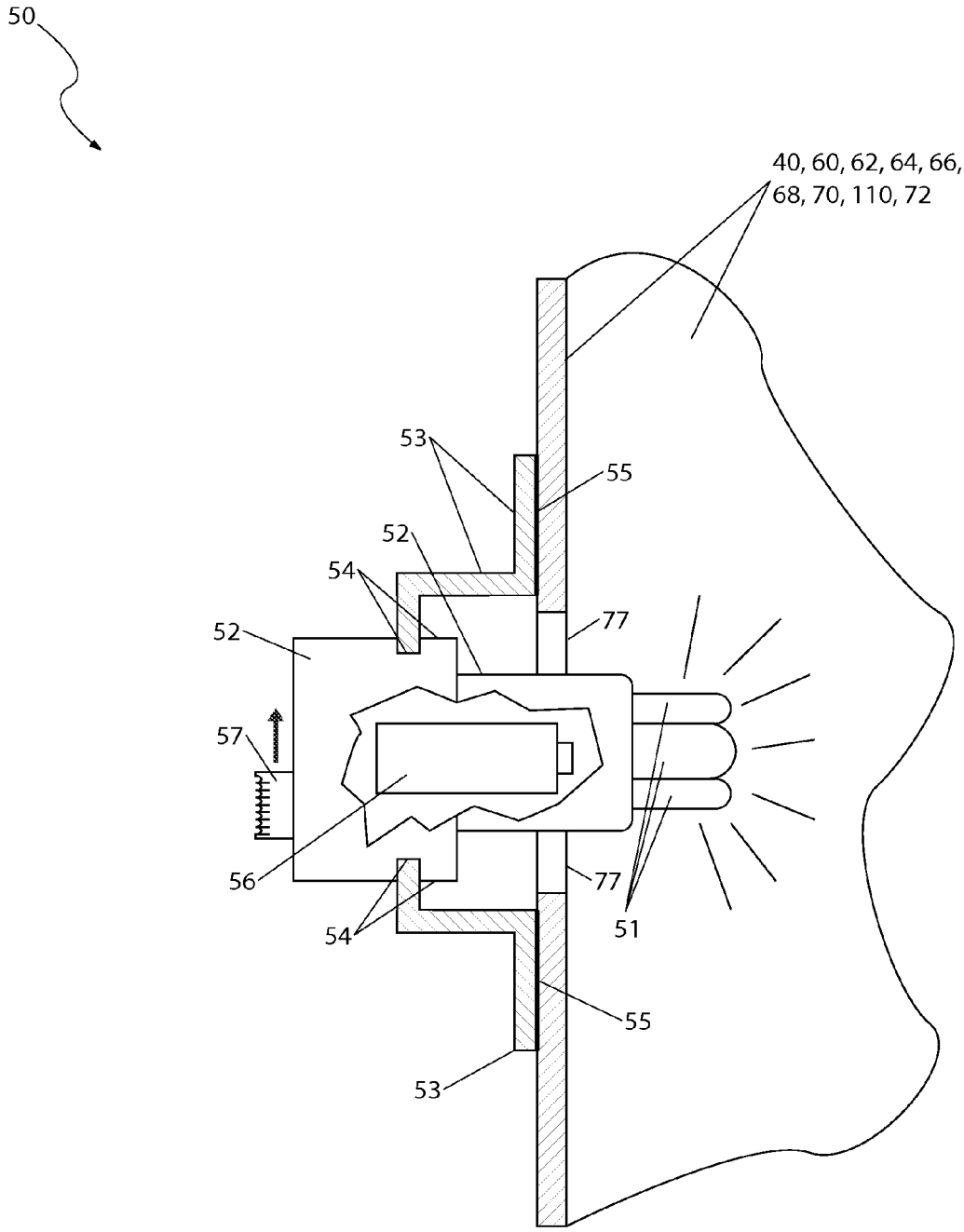
FIG. 6 is a close-up view of a lamp assembly portion 50 of the inflatable Nativity scene 10 according to a preferred embodiment of the present invention.
Figure 7:
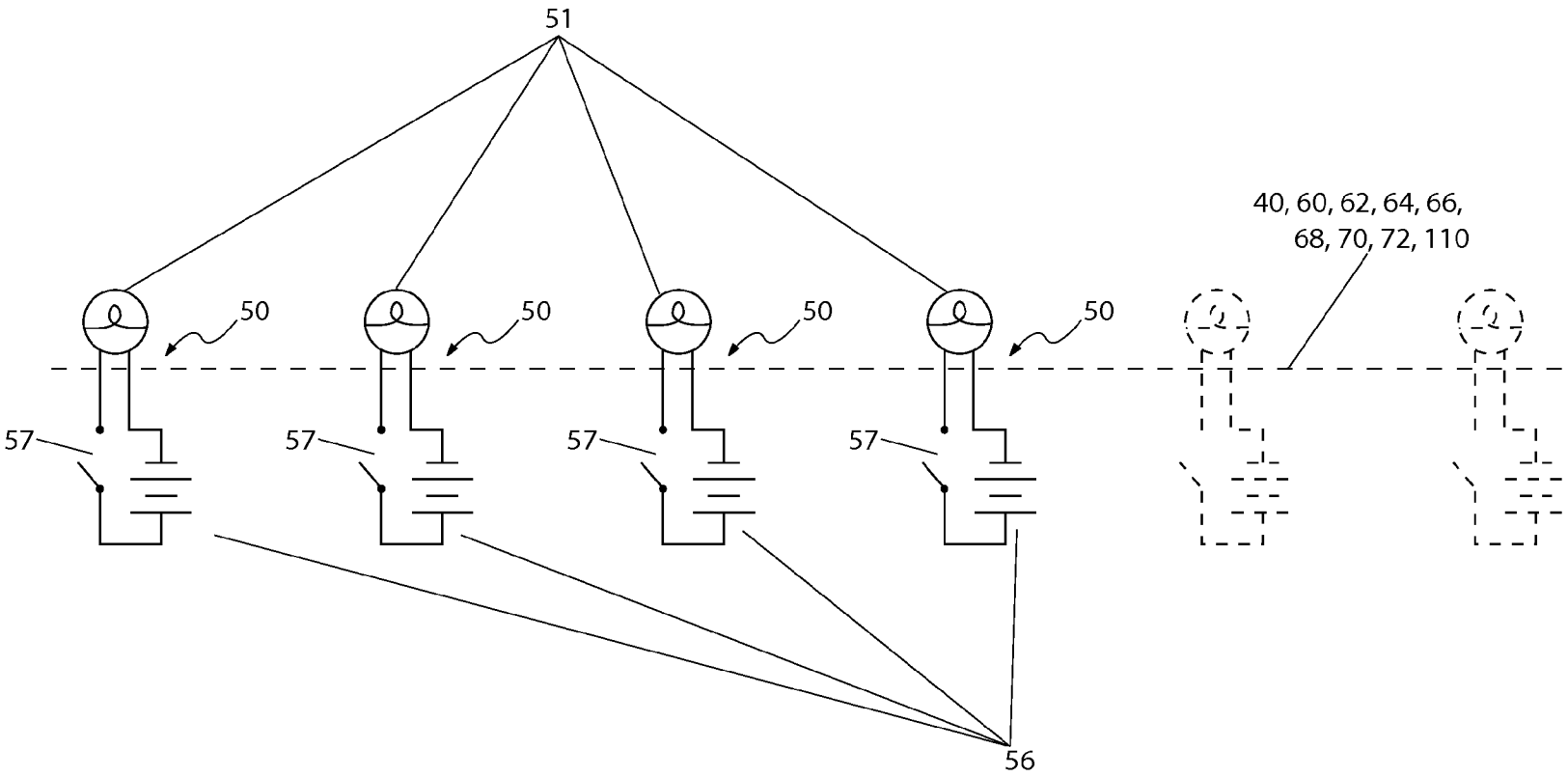
FIG. 7 is an electrical block diagram of the inflatable Nativity scene 10 according to a preferred embodiment of the present invention.

Referring now to FIGS. 6 and 7 at least some of the figurines 40, 60, 62, 64, 66, 67, 68, 70, 72, 110 are made sufficiently translucent to allow light transmission from internal lamp assemblies 50. Each lamp assembly 50 is battery-powered and detachable. The lamp assemblies 50 are located at discreet positions along surfaces of figurine 40, 60, 62, 64, 66, 68, 70, 110.

Each lamp assembly 50 has at least one (1) lamp 51, a lamp holder 52, a lamp socket 53, a battery 56, and a power switch 57. Each figurine 40, 60, 62, 64, 66, 68, 70, 72, 110 also has a lamp aperture 77 for a lamp assembly 50. Each lamp aperture 77 includes the plastic cylindrical socket 53 which is affixed to an external surface of its figurine 40, 60, 62, 64, 66, 68, 70, 72, 110 via an adhesive attachment 55, preferably comprising an industrial adhesive attachment or equivalent joining means. Each lamp socket 53 beneficially uses a cylindrical bayonet mounting feature 54 that is designed to receive a correspondingly lamp holder 52 using a quarter (¼) or (½) turn engagement method. The lamp holder 52 includes at least one (1) forwardly protruding integral lamp 51 which when inserted into a lamp socket 53 and extends slightly into its figurine 40, 60, 62, 64, 66, 68, 70, 72, 110. Illumination from the lamps 51 is distributed in an omni-directional manner to illuminate an interior space of a figurine 40, 60, 62, 64, 66, 68, 70, 72, 110.

The lamp 51 is envisioned to comprise a unitary or cluster of light-emitting-diodes (LED) or may utilize other lamp technologies to provide a desired lighting effect. The lamp assemblies 50 provide power to the lamp(s) 51 via an internal battery 56. The battery 56 works in conjunction with a two-position sliding power switch 57 that is positioned along a rearward surface of the lamp holder 52 to allow a user to easily turn each lamp assembly 50 on and off.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the Nativity scene 10, it would be installed and configured as indicated in FIGS. 1, 2, and 3.

The method of installing and utilizing the Nativity scene 10 may be performed by the following steps: procuring a model of the Nativity scene 10 having a desired overall size, and a desired selection and quantity of figurines 40, 60, 62, 64, 66, 67, 68, 70, 72, 110; selecting a suitable ground 115 area onto which the Nativity scene 10 may be erected; placing the base portion 20 upon the ground 115; arranging and attaching a desired combination of figurines 40, 60, 62, 64, 66, 67, 68, 70, 72, 110 to the base 20 at desired locations by snapping inflating couplings 78 into corresponding ring seals 82 of the inflating ports 22; inflating the Nativity scene 10 by attaching the hose 96 to the blower 90 by inserting and locking the first connection 94; starting the blower 90 by plugging the power cord portion 92 of the blower 90 into an available electrical outlet; positioning the blower 90 and hose 96 discreetly along the rear of the Nativity scene 10; allowing time for the base 20 and figurines 40, 60, 62, 64, 66, 67, 68, 70, 72, 110 to inflate; securing the Nativity scene 10 to the ground 115 by attaching a desired number (based upon anticipated weather conditions) of guy-rope assemblies 31 to the respective ring anchors 30; securing the guy-rope assemblies 31 by driving the stake portions of the guy-rope assemblies 31 into the ground surface 115; installing fresh batteries 56 into the lamp holder 52 of each lamp assembly 50 prior to insertion into the lamp sockets 53; inserting the lamp holders 52 into the lamp socket portions 53 of each selected figurine 40, 60, 62, 64, 66, 67, 68, 70, 72, 110; rotating and locking the lamp holders 52 using the bayonet mount portions 54 of the lamp sockets 53; activating the lamp assemblies 50 using respective power switches 57 when desired or during periods of low light; and, benefiting from a quick and easily means of erecting a large illuminated nativity scene 10 at almost any location in a manner which is quick, easy, and effective.

The modular design of the Nativity scene 10 allows a user to periodically reconfigure the number and positions of the figurines 40, 60, 62, 64, 66, 67, 68, 70, 72, 110 to create various displays without needing to completely deflating the Nativity scene 10. Various displays may be produced by detaching and re-attaching the figurines 40, 60, 62, 64, 66, 67, 68, 70, 72, 110 to/and from the base 20 using the inflating ports 22 and inflating couplings 78 as previously described, while utilizing the plugs 86 to seal unused inflating ports 22.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An inflatable scene, comprising:

a base comprised of a breathable and inflatable fabric material, said base having at least one inflating port having a semi-rigid seal ring around an opening through said base;

a figurine comprised of a breathable and inflatable fabric material and having a coupling portion having hollow cylindrical conduit with an annular groove dimensioned to mate with said seal ring;

a lamp assembly inside said figurine;

a tethered plug attached to said base, said tethered plug have an annular groove that mates to said seal ring so as to prevent air from coming out of said opening; and, an air blower for pressurizing said base, said air blower further for pressurizing said figurine with air passing through said opening;

wherein said figurine is attached to said base by said coupling portion and by said inflating port.

2. The inflatable scene according to claim 1, wherein said seal ring is permanently attached to said base.

3. The inflatable scene according to claim 1, further including a plurality of inflating ports arranged along said base.

4. The inflatable scene according to claim 1, further including a flexible hose connected between said base and said air blower such that air pressuring said base passes though said flexible hose.

5. The inflatable scene according to claim 1, wherein said air blower is AC powered.

6. The inflatable scene according to claim 1, wherein said figurine is a super structure.

7. The inflatable scene according to claim 6, wherein said super structure includes a canopy.

8. The inflatable scene according to claim 1, further including at least one ring anchor on said base.

9. The inflatable scene according to claim 8, wherein said at least one ring anchor is permanently affixed to said base.

10. The inflatable scene according to claim 9, wherein said at least one ring anchor secures said base to the ground.

11. The inflatable scene according to claim 1, further including a battery to power said lamp assembly.

12. The inflatable scene according to claim 11, further including a switch to selectively pass electrical power from said battery to said lamp assembly.

13. The inflatable scene according to claim 1, further including a plurality of figurines.

14. The inflatable scene according to claim 13, wherein said inflatable scene is a Nativity scene.

15. The inflatable scene according to claim 1, wherein said breathable and inflatable fabric material is plastic.

16. The inflatable scene according to claim 1, wherein an air blower is a high volume low pressure air pump.

17. The inflatable scene according to claim 16, wherein said air blower includes an AC cord.

18. The inflatable scene according to claim 16, wherein said figurine is translucent.

* * * * *